United States Patent [19]

Bhalla

[11] 4,152,620

[45] May 1, 1979

[54] HIGH INTENSITY VAPOR DISCHARGE LAMP WITH SINTERING AIDS FOR ELECTRODE EMISSION MATERIALS

[75] Inventor: Ranbir S. Bhalla, W. Paterson, N.J.

[73] Assignee: Westinghouse Electric Corp., Pittsburgh, Pa.

[21] Appl. No.: 920,900

[22] Filed: Jun. 29, 1978

[51] Int. Cl.[2] ..... H01J 61/068

[52] U.S. Cl. ..... 313/218; 313/213; 313/346 R

[58] Field of Search ..... 313/218, 346 R, 213

[56] References Cited

U.S. PATENT DOCUMENTS

| | | | |
|---|---|---|---|
| 2,162,414 | 6/1939 | Abbott | 313/211 X |
| 3,170,081 | 2/1965 | Rokosz | 313/213 |
| 3,708,710 | 1/1973 | Smyser et al. | 313/213 |
| 3,988,629 | 10/1976 | White et al. | 313/213 X |
| 4,052,634 | 10/1977 | De Kok | 313/213 X |

*Primary Examiner*—Palmer C. Demeo

*Attorney, Agent, or Firm*—B. R. Studebaker

[57] ABSTRACT

Sintering aids are disclosed which inprove the sintering of emission materials in high pressure discharge lamps. The sintering aid is a eutectic composition of at least one of barium oxide-tungsten oxide ($BaO—WO_3$), calcium oxide-tungsten oxide ($CaO—WO_3$), or strontium oxide-tungsten oxide ($SrO—WO_4$)and is mixed with the emission material in quantities of about 2 to 50 wt.% sintering aid and 50 to 98% emission material. Preferably, the sintering aid is present at between about 5 and 10 wt.%.

12 Claims, 5 Drawing Figures

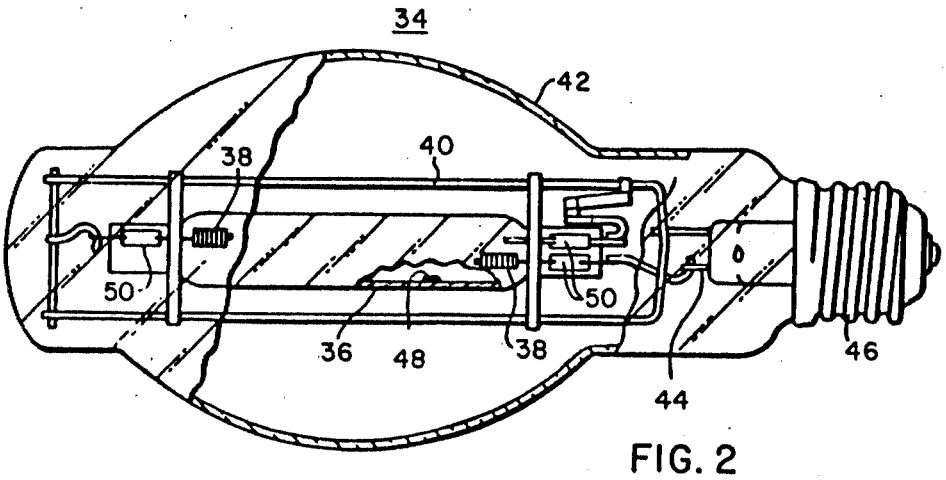
FIG. 2
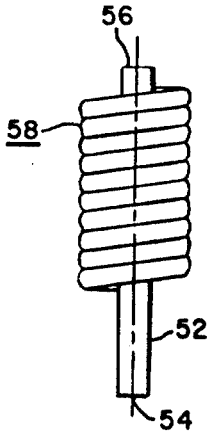
FIG. 3
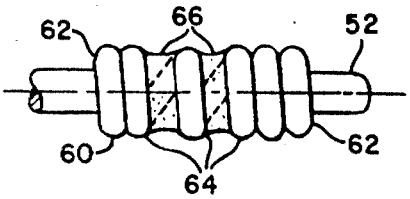
FIG. 4
FIG. 5
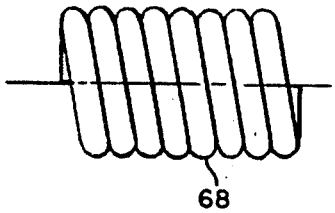

HIGH INTENSITY VAPOR DISCHARGE LAMP WITH SINTERING AIDS FOR ELECTRODE EMISSION MATERIALS

CROSS-REFERENCE TO RELATED APPLICATIONS

The sintering aids of this invention may be used with the emission materials disclosed in copending application Ser. No. 844,154, filed Oct. 21, 1977 for "HID LAMP ELECTRODE COMPRISING SOLID SOLUTION OF DIBARIUM CALCIUM MOLYBDATE AND TUNGSTATE", now U.S. Pat. No. 4,123,685, and application Ser. No. 845,521, filed Oct. 26, 1977 for "HID LAMP ELECTRODE COMPRISING BARIUM (YTTRIUM OR RARE EARTH METAL) TUNGSTATE OR MOLYBDATE", each filed by the present applicant and owned by the present assignee.

BACKGROUND OF THE INVENTION

This invention relates to high-intensity discharge (HID) lamps and, more particularly to sintering aids for use with the electron emissive material used in the electrodes of such lamps.

High-pressure sodium-mercury vapor lamps have in the past utilized as electron emissive material a mixture of several oxide phases comprising thorium dioxide, barium thorate, dibarium calcium tungstate and barium oxide. This mixture of oxide phases was quite sensitive to the atmospheric contaminants with the result that even a brief exposure to air resulted in a relatively large pickup of water and carbon dioxide by the emission mixture. Such contaminants were rather difficult to remove. Silica ($SiO_2$) was an effective sintering aid in connection with the foregoing emission material.

More recently, as disclosed in U.S. Pat. No. 3,708,710 dated Jan. 2, 1973 a high-intensity-discharge sodium-mercury vapor lamp which utilizes dibarium calcium tungstate as the electron emissive material, particularly effective in sodium vapor lamps employing polycrystalline alumina arc tube bodies, has been disclosed. Similarly, U.S. Pat. No. 4,052,634 dated Oct. 4, 1977 discloses an emission material for high-pressure mercury vapor and high pressure sodium vapor discharge lamps which consist mainly of one or more oxide compounds containing at least one of the rare earth metal oxides, alkaline earth metal oxide in a quantity of 0.66 to 0.40 mole per mole of rare earth oxide and at least one of the oxides of tungsten and molybdenum in a quantity of 0.25 to 0.40 mole per mole of alkaline earth metal oxide, the alkaline earth metal oxide consisting of at least 25 mole % of barium oxide. Additionally, the above referenced copending applications disclose new electron emissive materials for use in such lamps which comprise solid solutions of dibarium calcium tungstate ($Ba_2CaWO_6$) and dibarium calcium molybdate ($Ba_2CaMoO_6$) and electron emissive materials consisting essentially of $M_3M'_2M''O_9$, wherein: M is alkaline earth metal and at least principally comprises barium; M' is yttrium, a lanthanoid series metal, or any mixtures thereof; and M'' is tungsten, molybdenum, or mixtures thereof.

These latter electron emissive materials after sintering usually have a consistency of a "soft powder" and small particles of the emission material can dust off during handling of the finished electrodes or even finished lamps. If this dusting does occur, the amount of electron emissive material retained on the electrodes will be reduced and may possibly shorten the life of the lamp. In addition, any dusting during lamp life can result in dark emission material particles depositing on the inside surface of the arc tubes, which deposited emission particles have a tendency to quickly spread and darken the arc tube and hence reduce the light output of the lamp. The use of silica ($SiO_2$) as a sintering aid with these newer electron emissive materials has not been effective. Providing electron emissive material, after sintering, which has the consistency of a "soft brick" results in a significantly improved electrode structure and essentially eliminates any problem of dusting during handling of the finished electrodes and finished lamps.

SUMMARY OF THE INVENTION

In accordance with the present invention sintering aids in the form of eutectic compositions of $BaO—WO_3$, $CaO—WO_3$ or $SrO—WO_3$ are admixed with the electron emissive material in the discharge sustaining electrodes of a high intensity discharge lamp.

The high intensity vapor discharge lamp generally comprises a radiation-transmitting arc tube having electrodes operatively supported therein proximate the ends thereof which are adapted to have an elongated arc discharge maintained therebetween and means for connecting the electrodes to an energizing power source. An improved structure for the electrodes is provided which comprises an elongated refractory metal member having one end portion thereof supported proximate an end of said arc tube and the other end portion of said metal member projecting a short distance inwardly within the arc tube. The inwardly projecting ends are provided with an overfitting refractory metal coil means carried on the inwardly projecting portion thereof. An electron emissive material is carried intermediate the turns of the overfitting coil. This electron emissive material is preferably selected from one or more of the group comprising $Ba_2CaM''O_6$ and $M_3M'_2$ and $M''O_9$, wherein M is alkaline-earth metal and at least principally comprises barium, M' is yttrium or other lanthanoid series rare-earth metal or any mixtures thereof and M'' is tungsten or molybdenum or any mixtures thereof, the sintering aid is intermixed with the electron emissive material and is present in amounts of from between about 2–50 wt.% sintering aid and 98–50 wt.% emissive material. Preferably, the sintering aid is present in the admixture in an amount of between about 5–10 wt.%. Additionally, in some instances, particularly for mercury-vapor lamps, it is preferable to mix a refractory metal powder with the lanthanoid series emissive materials with the powder constituting about 20 wt.% of the emissive material.

BRIEF DESCRIPTION OF THE DRAWINGS

Many of the attendant advantages of the present invention will become better understood as the following detailed description is considered in connection with the accompanying drawings, in which:

FIG. 2 is an elevational view of an HID mercury-vapor lamp which incorporates the present electrodes;

FIG. 3 is an enlarged view of the electrode tip portion showing the refractory coil carried thereon;

FIG. 4 is an elevational view of the tip portion of the electrode as partially fabricated showing an inner coil which has the improved electron emissive material and sintering aid carried intermediate spaced turns thereof; and FIG. 5 is an elevational view of the overfitting coil which is screwed in place onto the inner coil as shown in FIG. 4 in order to complete the electrode.

DESCRIPTION OF THE PREFERRED EMBODIMENTS

Figure 1:
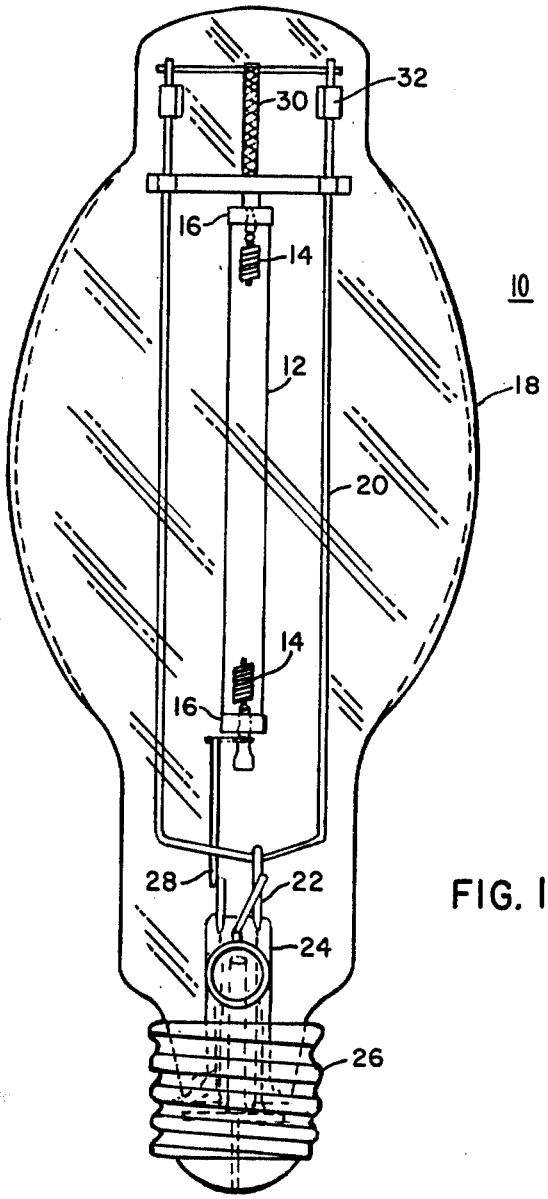
FIG. 1 is an elevational view of a typical HID sodium-mercury lamp which incorporates the present improved electrodes.

Referring now in detail to the drawings wherein like reference characters represent like parts throughout the several views, there is illustrated in FIG. 1 a typical HID sodium-mercury lamp 10 comprising a radiation transmitting arc tube 12 having electrodes 14 operatively supported therein proximate the ends thereof and adapted to have an elongated arc discharge maintained therebetween. The arc tube is fabricated of refractory material such as single crystal or polycrystalline alumina having niobium end caps 16 sealing off the ends thereof. The arc tube 12 is suitably supported within a protective outer envelope 18 by means of a supporting frame 20 which is connected to one lead-in conductor 22 sealed through a conventional stem press arrangement 24 for connection to the conventional lamp base 26. The other lead-in conductor 28 connects to the other lamp electrode 14. Electrical connection to the uppermost electrode 14 is made through the frame 20 and a resilient braided connector 30 to facilitate expansion and contraction of the arc tube 12 and the frame 20 is maintained in position within the bulb by suitable metallic spring spacing members 32 which contact the inner surface of the dome portion of the protective envelope 18. As a discharge sustaining filling, the arc tube contains a small controlled charge of sodium-mercury amalgam and a low pressure of inert ionizable starting gas such as 20 torrs of xenon.

The high-pressure mercury vapor lamp 34, as shown in FIG. 2, is also generally conventional and comprises a light transmitting arc tube 36 which is usually fabricated of quartz having the operating electrodes 38 operatively supported therein proximate the ends thereof and adapted to have an elongated arc discharge maintained therebetween. The conventional supporting frame 40 serves to suitably support the arc tube within the protective outer envelope 42 and to provide electrical connection to one of the electrodes. The other electrode is connected directly to one of the lead-in conductors 44 and thence to the base 46 so that the combination provides means for connecting the lamp electrodes 38 to an energizing power source. As is conventional, the lamp contains a small charge of mercury 48 which together with an inert ionizable starting gas comprises a radiation sustaining filling. In this lamp embodiment, ribbon seals 50 provided at the ends of the arc tube 36 facilitate sealing the lead-in conductors therethrough in order to connect to the electrodes. FIG. 3 illustrates an enlarged fragmentary view of an electrode suitable for use in an HID lamp. The electrode comprises an elongated refractory metal member 52 having one end portion thereof 54 which is adapted to be supported proximate the end of the lamp arc tube with the other end portion 56 of the metal member adapted to project a short distance inwardly within the arc tube. An overfitting refractory metal coil means 58 is carried on the elongated metal member 52 proximate the end 56 thereof. As a specific example, the elongated metal member is formed as a tungsten rod having a diameter of approximately 0.032 inch (0.8 mm.) and the overfitting coil 58, as shown in FIG. 3, comprises 8 turns of tungsten wire which has a diameter of 0.016 inch (0.4 mm.). The outer diameter of the coil 58 can vary from 0.09 inch (2.29 mm.) to 0.11 inch (2.8 mm.).

The electrode coil in a state of assembly is shown in FIGS. 4 and 5 wherein the elongated refractory metal member 52 has a first inner coil 60 wrapped directly thereon and having a pitch between individual turns intermediate the coil ends 62 that there exists a predetermined spacing between the centrally disposed turns 64. As a specific example, the spacing between the centrally disposed individual turns 64 is approximately equal to the diameter of the wire from which the inner coil is formed. This spacing forms a protected repository for the majority of the mixture of emission material and sintering aid 66 which is carried by the electrode structure. An electrode construction such as the foregoing is generally known in the art, as disclosed in U.S. Pat. No. 3,170,081, dated Feb. 16, 1965.

U.S. Pat. No. 3,708,710 describes the preparation and use of an emission material principally comprising dibarium calcium tungstate ($Ba_2CaWO_6$) for use in electrodes for high intensity discharge lamps and the process for preparing that emission material. The referenced copending application Ser. No. 844,154, filed Oct. 26, 1977 for "HID LAMP ELECTRODE COMPRISING SOLID SOLUTION OF DIBARIUM CALCIUM MOLYBDATE AND TUNGSTATE" discloses an electron emissive material having a gram-molecular ratio of tungstate to molybdate from 9:1 to 1:9 and preferably a moler ratio of tungstate to molybdate which falls within the range of from 1:1 to 1:4 along with the method of preparing that electron emissive material. The referenced copending application Ser. No. 845,521, filed Oct. 26, 1977 for "HID LAMP ELECTRODE COMPRISING BARIUM (YTTRIUM OR RARE EARTH METAL) TUNGSTATE OR MOLYBDATE" discloses an electron emissive material consisting essentially of $M_3M'_2M''O_9$ wherein: M is alkaline-earth metal and at least principally comprises barium; M' is yttrium, a lanthanoid series rare earth metal, or mixtures thereof; and M'' is tungsten, molybdenum or mixtures thereof and more particularly the species barium yttrium tungstate ($Ba_3Y_2WO_9$) along with methods for preparing that electron emissive material. With this emission material, it has been found desirable to mix finely divided refractory metal particles of tungsten, molybdenum, tantalum or niobium, or mixtures thereof, with the refractory metal powder comprising from 5% to 80% by weight of the emission material. This metal powder desirably is in an extremely fine state of division with a representative particle size for the powder being 0.06 to 0.2 micron. Tungsten powder is preferred with a specific particle size being about 0.11 micron. The added metal powder acts as a refractory matrix to increase the mechanical stability of the emission material and it also minimizes sputtering of the oxide emission material when the lamp is initially started. The preferred finely divided tungsten powder preferably comprises from about 20% by weight of the emission material which in its preferred form is barrium yttrium tungstate.

Although each of the foregoing emission materials provide good performance in HID lamps, there is a tendency, after sintering, for the emission material which is now on or within the electrode structure to be in the form of a "soft powder" which can be dislodged and "dust off" of the electrode. Preferably, a consistency much like "soft brick" would reduce this tendency of the emission material to be dislodged from the electrode. In this connection, it has been found that when predetermined amounts of eutectic mixtures of barium oxide-tungsten oxide ($BaO—WO_3$), calcium oxide-tungsten oxide ($CaO—WO_3$) or strontium oxide-tungsten oxide ($SrO—WO_3$), or combinations thereof, are intermixed with the emission material much harder sintering of the emission material will be accomplished. The lowest eutectic mixtures of each of the $BaO—WO_3$, $SrO—WO_3$, and $CaO—WO_3$ systems are preferable and occur at 25 mole % BaO—75 mole % $WO_3$ with a melting temperature of 935° C., 24 mole % SrO—76 mole % $WO_3$ with a melting temperature of 1073° C. and 25 mole % CaO—75 mole % $WO_3$ with a melting temperature of 1135° C. A eutectic composition of 58.2 mole % BaO and 41.8% $WO_3$ is also suitable, with a eutectic temperature of 1320° C.

As a specific example 493 grams of barium carbonate ($BaCO_3$) and 1740 grams $WO_3$ ($WO_{2.97}$) are ball milled in alcohol and then dried in an oven at 70° C. The dry mixture is then placed in silica boats and fired at 800° C. for 1 hour and 900° C. for 4 hours driving off the $CO_2$ leaving the eutectic mixture of $BaO—WO_3$. The mixture is then again dry ball milled to achieve thorough mixing.

A mixture of 95% electron emissive material and 5% sintering aid is then ball milled with an alcohol vehicle to homogenize the mixture. This material now formed as a thick paste using the alcohol vehicle is applied over the innermost coil 60, as shown in FIG. 4. After drying, the outer coil 68, as shown in FIG. 5, is screwed in place over the inner coil to provide an additional degree of protection and to prevent the electron emissive material in combination with the sintering aid 66 from becoming dislodged from the electrode. The completed electrode is then fired at between 1500° and 1600° C. for from 10 to 15 minutes to provide hard sintering of the electron emissive material. This firing is accomplished under hydrogen and free tungsten oxide is reduced to tungsten metal. The same procedure may be accomplished employing mixtures of 250 grams calcium carbonate ($CaCO_3$) and 1740 grams $WO_3$ or 354 grams of strontium carbonate ($SrCO_3$) and 1760 grams of tungsten oxide ($WO_3$) each of which also provides a "soft brick" consistency to the emission material. Alternatively, the different sintering aids can be mixed in their eutectic proportions.

Although it is desirable to prefire the eutectic sintering aid mixtures, it is not necessary and these mixtures may be used in an unfired condition when mixed with the emission material.

It would also appear that eutectic mixtures of barium oxide-molybdenum oxide ($BaO—MoO_3$), calcium oxide-molybdenum oxide ($CaO—MoO_3$) and strontium oxide-molybdenum oxide ($SrO—MoO_3$) are equally as effective as the mixtures of barium oxide, calcium oxide and strontium oxide with tungsten oxide and, accordingly, can be substituted in whole or in part, in their eutectic proportions, for the latter.

The weight percentage of electron emissive material to sintering aid may be from between about 2–50 wt.% sintering aid to between about 50–98 wt.% electron emissive material. Preferably, the ratio of electron emissive material to sintering aid should be between about 5–10 wt.% sintering aid to between about 90–95 wt.% electron emissive material. Since between 5–10 wt.% sintering aid appears to be sufficient to eliminate the problem of dusting, it is more important that the area between the coils 64 be primarily filled with electron emissive material in order to support and maintain a discharge during the life of the lamp.

As will be seen from the foregoing, by adding to selected electron emissive materials for high intensity discharge lamps, small quantities of a sintering aid, the problem of dusting or flaking off of emission material during the fabrication and operation of the discharge lamp can be significantly reduced.

What is claimed is:

1. In combination with a high intensity vapor discharge lamp comprising a radiation transmitting arc tube having electrodes operatively supported therein proximate the ends thereof and adapted to have an elongated arc discharge maintained therebetween, and means for connecting said electrodes to an energizing power source, the improved structure for said electrodes each of which comprises:

an elongated refractory metal member having one end portion thereof supported proximate and end of said arc tube and the other end portion of said metal member projecting a short distance inwardly within said arc tube, and overfitting refractory metal coil means carried on the inwardly projecting portion of said elongated metal member;

an electron emissive material carried intermediate turns of said overfitting coil means, said electron emissive material selected from one of the group consisting of $Ba_2CaM''O_6$ and $M_3M'_2M''O_9$, wherein M is alkaline earth metal and at least principally comprises barium, M' is yttrium or lanthanoid series rare earth metal or any mixtures thereof, and M'' is tungsten or molybdenum or any mixtures thereof; and a predetermined percentage of sintering aid intermixed with said electron emissive material, said sintering aid selected from one or more of the eutectic mixtures of barium oxide-tungsten oxide ($BaO—WO_3$), calcium oxide-tungsten oxide ($CaO—WO_3$) and strontium oxide-tungsten oxide ($SrO—WO_3$).

2. The combination of claim 1 wherein said electron emissive material and said sintering aid are present in amounts of from between about 2–50 wt.% sintering aid and from between about 50–98 wt.% electron emissive material.

3. The combination according to claim 1 wherein said electron emissive material and said sintering aid are present in amounts of between about 5–10 wt.% sintering aid and between about 90–95 wt.% electron emissive material.

4. In combination with a high intensity vapor discharge lamp comprising a radiation transmitting arc tube having electrodes operatively supported therein proximate the ends thereof and adapted to have an elongated arc discharge maintained therebetween, and means for connecting said electrodes to an energizing power source, the improved structure for said electrodes each of which comprises:

an elongated refractory metal member having one end portion thereof supported proximate an end of said arc tube and the other end portion of said metal member projecting a short distance inwardly within said arc tube, and overfitting refractory metal coil means carried on the inwardly projecting portion of said elongated metal member;

an electron emissive material carried intermediate turns of said overfitting coil means, said electron emissive material selected from one of the group consisting of $Ba_2CaM''O_6$ and $M_3M'_2M''O_9$ wherein M is alkaline-earth metal at least principally comprising barium; M' is yttrium, a lanthanoid series rare earth metal, or mixtures thereof; and M'' is tungsten, molybdenum or mixtures thereof; and a predetermined percentage of a sintering aid intermixed with said electron emissive material, said sintering aid selected from one or more of the eutectic oxide with either tungsten oxide or molybdenum oxide or mixtures thereof.

5. The combination of claim 4 wherein said electron emissive material and said sintering aid are present in amounts of from between about 2–50 wt.% sintering aid and from between about 50–98 wt.% electron emissive material.

6. The combination according to claim 4 wherein said electron emissive material and said sintering aid are present in amounts of between about 5–10 wt.% sintering aid and between about 90–95 wt.% electron emissive material.

7. In combination with a high intensity vapor discharge lamp comprising a radiation transmitting arc tube having electrodes operatively supported therein proximate the ends thereof and adapted to have an elongated arc discharge maintained therebetween, and means for connecting said electrodes to an energizing power source, the improved structure for said electrodes each of which comprises:

an elongated refractory metal member having one end portion thereof supported proximate an end of said arc tube and the other end portion of said metal member projecting a short distance inwardly within said arc tube, and overfitting refractory metal coil means carried on the inwardly projecting portion of said elongated metal member;

an electron emissive material carried intermediate turns of said overfitting coil means, said electron emissive material selected from one of the group consisting of $Ba_2CaM''O_6$ and $M_3M'_2M''O_9$, wherein M is alkaline earth metal and at least principally comprises barium, M' is yttrium or lanthanoid series rare earth metal or any mixtures thereof, and M'' is tungsten or molybdenum or any mixtures thereof in combination with a finely divided refractory metal powder; and a predetermined percentage of sintering aid intermixed with said electron emissive material, said sintering aid selected from one or more of the eutectic mixtures of barium oxide-tungsten oxide ($BaO-WO_3$), calcium oxide-tungsten oxide ($CaO-WO_3$) and strontium oxide-tungsten oxide ($SrO-WO_3$).

8. The combination of claim 7 wherein said electron emissive material and said sintering aid are present in amounts of from between about 2–50 wt.% sintering aid and from between about 50–98 wt.% electron emissive material and refractory metal powder combination.

9. The combination according to claim 7 wherein said electron emissive material and said sintering aid are present in amounts of between about 5–10 wt.% sintering aid and between about 90–95 wt.% electron emissive material and refractory metal powder combination.

10. The combination according to claim 7, wherein said combined electron emissive material and refractory metal powder is from 5 to 80 wt.% of finely divided refractory metal powder.

11. The combination according to claim 10 wherein said refractory metal powder is at least one of tungsten, molybdenum, tantalum or niobium.

12. The combination as specified in claim 7 or 10, wherein said refractory metal powder is tungsten and is about 20 wt.% of said combined electron emissive material and said refractory metal powder.

* * * * *